US007775339B2

(12) United States Patent
Ogimura

(10) Patent No.: US 7,775,339 B2
(45) Date of Patent: Aug. 17, 2010

(54) PASSENGER CONVEYOR

(75) Inventor: Yoshio Ogimura, Himeji (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 282 days.

(21) Appl. No.: 10/575,252

(22) PCT Filed: Oct. 8, 2004

(86) PCT No.: PCT/JP2004/015307

§ 371 (c)(1),
(2), (4) Date: Nov. 21, 2007

(87) PCT Pub. No.: WO2005/035425

PCT Pub. Date: Apr. 21, 2005

(65) Prior Publication Data

US 2008/0116035 A1 May 22, 2008

(30) Foreign Application Priority Data

Oct. 10, 2003 (JP) ..... 2003-351807

(51) Int. Cl.
*B66B 23/00* (2006.01)

(52) U.S. Cl. ..... 198/324; 198/323; 362/146

(58) Field of Classification Search ..... 198/321–324; 362/146

See application file for complete search history.

(56) References Cited

U.S. PATENT DOCUMENTS 5,067,062 A * 11/1991 Rulke ..... 362/146
5,339,228 A * 8/1994 Baethge et al. ..... 362/146
5,431,271 A * 7/1995 Abraham et al. ..... 198/324
5,613,758 A * 3/1997 Kamschal et al. ..... 362/576
5,782,330 A * 7/1998 Mehlert et al. ..... 198/324
5,923,005 A 7/1999 Blondiau et al.
6,334,522 B2 * 1/2002 Haruta et al. ..... 198/322
6,848,805 B2 * 2/2005 Pietz ..... 362/146
6,988,607 B2 * 1/2006 Blondiau et al. ..... 198/322
7,108,393 B2 * 9/2006 Kleewein et al. ..... 362/146
7,134,539 B2 * 11/2006 Kim ..... 198/338
7,249,667 B2 * 7/2007 Sansevero et al. ..... 198/324

FOREIGN PATENT DOCUMENTS

DE 20019698 U1 4/2001
EP 07285774 10/1995
EP 0 879 783 11/1998
EP 0 879783 11/1998
EP 1 097 898 5/2001

(Continued)

*Primary Examiner*—Douglas A Hess
(74) *Attorney, Agent, or Firm*—Oblon, Spivak, McClelland, Maier & Neustadt, P.C.

(57) ABSTRACT

In a passenger conveyor according to the present invention, an inlet safety device, an operation device, an operation condition display device, and a passenger detecting device are all received in a end-deck cover at an end of a balustrade panel. Thus, the passenger conveyor is excellent in design because of a simple appearance of a platform and a vicinity thereof. Since an inclined surface of the end-deck cover on which a display part of the operation condition display device is disposed is inclined to face an upper side of a center part of the platform, an observability by a passenger of the display part of the operation condition display device can be exceedingly enhanced.

14 Claims, 12 Drawing Sheets

FOREIGN PATENT DOCUMENTS

| | | | |
|---|---|---|---|
| EP | 1142820 | A1 | 10/2001 |
| JP | 57-160883 | | 10/1982 |
| JP | 63-143192 | | 6/1988 |
| JP | 64-034889 | | 2/1989 |
| JP | 2000-272864 | | 10/2000 |
| JP | 2001-002357 | | 1/2001 |
| JP | 2001097659 | A | 4/2001 |
| JP | 2001-261273 | | 9/2001 |
| JP | 2002-160885 | | 6/2002 |
| JP | 2003020183 | A | 1/2003 |

* cited by examiner

PASSENGER CONVEYOR

BACKGROUND OF THE INVENTION

1. Field of the Invention

The present invention relates to a passenger conveyor such as an escalator and a moving walkway. More particularly, it pertains to a passenger conveyor in which an operation condition display device, a passenger detecting device, and so on are compactly disposed near a platform at an end of a balustrade panel where a handrail enters and exits.

2. Background Art

In recent years, passenger conveyors such as escalators and moving walkways have been Installed one after another in order to prepare for an aged society. In a platform 2 of a conventional escalator 1 shown in FIG. 13, a handrail 4 moving along an outer periphery of a balustrade panel 3 is downwardly curved to change Its advancing direction 180°. The handrail 4 then moves parallel with a floor 2*a* of the platform 2 to move into an inlet 5 formed at an end of the balustrade panel 3.

The end of the balustrade panel 3 is covered with an end-deck cover 6 for an attractive design. A front surface 6*a* of the end-deck cover 6 is generally postured perpendicular to a floor 2*a* of the platform 2.

As shown in FIG. 13, an operation panel 7 for operating the escalator 1 is attached on a side surface 6*b* of the end-deck cover 6.

As shown in FIGS. 14 and 15, an inlet safety device 8 and switches of the operation panel 7 are received within the end-deck cover 6. If a passenger has his or her body, clothing, or baggage drawn Into the inlet 5, the inlet safety device 8 detects the trouble and stops the operation of the escalator 1.

As shown in FIG. 16, some passenger conveyors have a pair of right and left standing columns 11L and 11R disposed in front of the platform 2. The pair of columns 11L and 11R respectively have a pair of detecting sensors 12L and 12R between which an optic axis is formed. Upon interruption of the optical axis by a passenger approaching the escalator 1, the escalator 1 can be activated or accelerated.

Passenger conveyors are usually installed in public gathering places such as train stations and airports, shopping centers, department stores, and hotels. In addition, an increased number of elderly people use passenger conveyors. In the light of the circumstances, there has been a tendency that information relating to operating conditions of a passenger conveyor is displayed for a passenger so as to indicate the moving direction, whether or not the passenger can board from a certain direction, and so on.

Such a device for displaying operation information includes a display part of a light emitter or the like, a control board for controlling an operation of the display part, etc. With a view to its function, the display device must be disposed at a platform of a passenger conveyor.

However, when the display device is provided on the columns 11L and 11R shown in FIG. 16 which stand on right and left sides of the platform 2, not only does a design of the platform 2 and its vicinity deteriorate, but also a manufacturing cost increases because of a need for members such as columns 11L and 11R.

Similarly, it is not preferable in terms of the design and the manufacturing cost to provide, as shown in FIG. 16, the detecting sensors 12L and 12R for detecting an approach of a passenger on the right and left columns 11L and 11R disposed in front of the platform 2.

Then, as shown in FIG. 17, a passenger detecting sensor 14 can be disposed below the inlet 5.

However, there are the disadvantages that the passenger detecting sensor 14 is exposed to the platform 2, which deteriorates a design thereof. Further, since a part of the handrail 4 entering or exiting the inlet 5 is extended parallel to the floor 2*a* of the platform 2, a detection area where an approach of a passenger can be detected is narrowed.

SUMMARY OF THE INVENTION

An object of the present invention is to provide a passenger conveyor which can solve the above conventional disadvantages, and is excellent in design. The passenger conveyor according to the present invention has an operation device, an inlet safety device, a display device, and a passenger detecting device which are compactly received in an end-deck cover disposed at an end of a balustrade panel, without impairing a display function and a passenger detecting function of these devices, but keeping a simple maintainability thereof.

The present invention for achieving the above object is a passenger conveyor including an escalator and a moving walkway, comprising: a handrail endlessly moving along an outer periphery of a balustrade panel; an end-deck cover disposed at an end of the balustrade panel near a floor of a platform, for covering a part where the handrail enters and exits; a handrail inlet safety device for stopping an operation of the passenger conveyor when a foreign matter is drawn into the part where the handrail enters and exits; an operation device for operating the passenger conveyor; and an operation condition display device for displaying an operation condition of the passenger conveyor to a passenger; wherein the handrail inlet safety device, the operation device, and the operation condition display device are disposed in the end-deck cover.

The handrail can be formed to have a part which is linearly extended at a predetermined angle relative to the floor of the platform, when viewed horizontally from the lateral side, so as to enter and exit the end-deck cover.

The end-deck cover has an inclined surface which is inclined to face a center part of the floor of the platform when viewed vertically from above, and is inclined to face an upper side of the center part when viewed horizontally from the lateral side.

The operation condition display device is arranged in the end-deck cover such that a display surface of the operation condition display device is extended along the inclined surface.

The handrail inlet safety device is formed to have a width dimension equal to or smaller than a width dimension of the handrail when viewed from the front, and a smaller thickness when viewed from the lateral side. The handrail inlet safety device is arranged in the end-deck cover along a lower surface of the handrail.

The operation condition display device is disposed in an inner space of the end-deck cover, which is a triangular space formed between a lower surface of the handrail extending in the end-deck cover and the floor of the platform when viewed horizontally from the lateral side.

The operation condition display device includes a display part which is disposed along the inclined surface of the end-deck cover and has a light emitter for displaying information, and a display control part which is horizontally arranged rearward the display part.

The operation condition display device can be arranged in the end-deck cover below the handrail inlet safety device.

The operation device can be arranged in the end-deck cover on a side of the handrail inlet safety device and the operation condition display device.

The passenger detecting device can be arranged in the end-deck cover on a side of the display part of the operation condition display device.

The passenger conveyor according to the present invention can further comprise: a surface plate of an outside wall surface forming the balustrade panel, which provides an outside wall surface facing a step where a passenger gets on; a screw for thread-mounting the surface plate on a frame; and an ornamental member attached on an outer surface of the surface plate, for covering a head of the screw.

The passenger conveyor according to the present invention can further comprise: a skirt guard extending adjacent to a step where a passenger gets on and off; and a strip-like light means for lighting the step, which is disposed on the skirt guard and is extended along a length thereof.

The light means may include a fluorescent light and a light bulb attached on a rear surface of the skirt guard, and a light-emitting diode attached on a front surface of the skirt guard.

In the passenger conveyor according to the present invention, all of the inlet safety device, the operation device, the operation condition display device, and the passenger detecting device can be received in the end-deck cover at an end of the balustrade panel. Thus, the passenger conveyor is excellent in design because of a simple appearance of the platform and a vicinity thereof. Further, there is no need for changing a design of the passenger conveyor, when the operation condition display device and the passenger detecting device are not disposed thereon. Thus, time and cost required for manufacturing the passenger conveyor can be reduced.

Since the handrail has a part which is linearly extended at a predetermined angle relative to the floor of the platform so as to enter or exit the end-deck cover, a larger space can be secured between a lower surface of the handrail and the floor. Thus, there is less risk for a passenger to be caught therein. Further, a sufficiently large space can be secured in the end-deck cover to receive therein the inlet safety device, the operation device, the operation condition display device, and the passenger detecting device.

In addition, the operation device can be disposed away from the step in the inner space of the end-deck cover. Thus, a safety of the escalator operated by the operation device can be improved.

Since the inclined surface of the end-deck cover on which the display part of the operation condition display device is disposed is inclined to face the upper side of the center part of the platform, an observability by a passenger of the display part of the operation condition display device can be exceedingly enhanced.

Since the handrail inlet safety device, the operation condition display device, the operation device, and the passenger detecting device are laid out in the end-deck cover both in the lateral and vertical directions, the inner space of the end-deck cover can be efficiently used.

A head of the screw for thread-mounting the surface plate forming the outer wall surface facing the step on the frame is covered with the ornamental member. Thus, the screw is invisible to a passenger, which further improves a design of the balustrade panel and a vicinity thereof.

Since the strip-like light means is disposed along the length of the skirt guard, not only can the step be brightly lighted, but also a boundary between the step and the skirt guard can be readily identified. Therefore, troubles such as a passenger's shoe being caught in a gap therebetween can be prevented from occurring.

DETAILED DESCRIPTION OF THE INVENTION

Embodiments of a passenger conveyor according to the present invention are hereinafter described in detail with reference to FIGS. 1 to 12. In the description below, the parts having the same structure and function have the same reference numbers, and overlapped description will be omitted.

General structures of the embodiments of a passenger conveyor according to the present invention are described below with reference to FIGS. 1 to 3.

Figure 1:
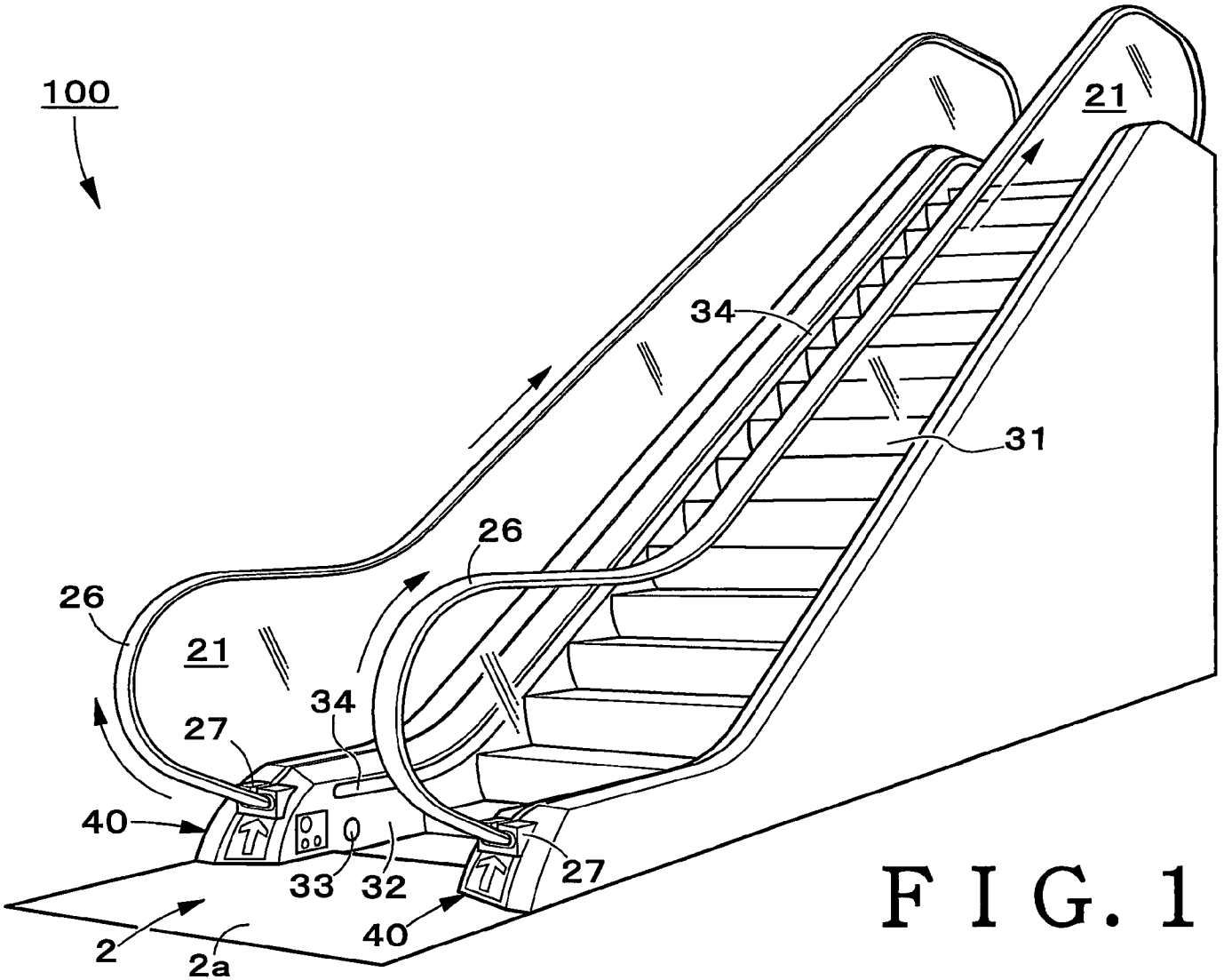
FIG. 1 is a general perspective view showing a passenger conveyor of a first embodiment of the present invention.
Figure 2:
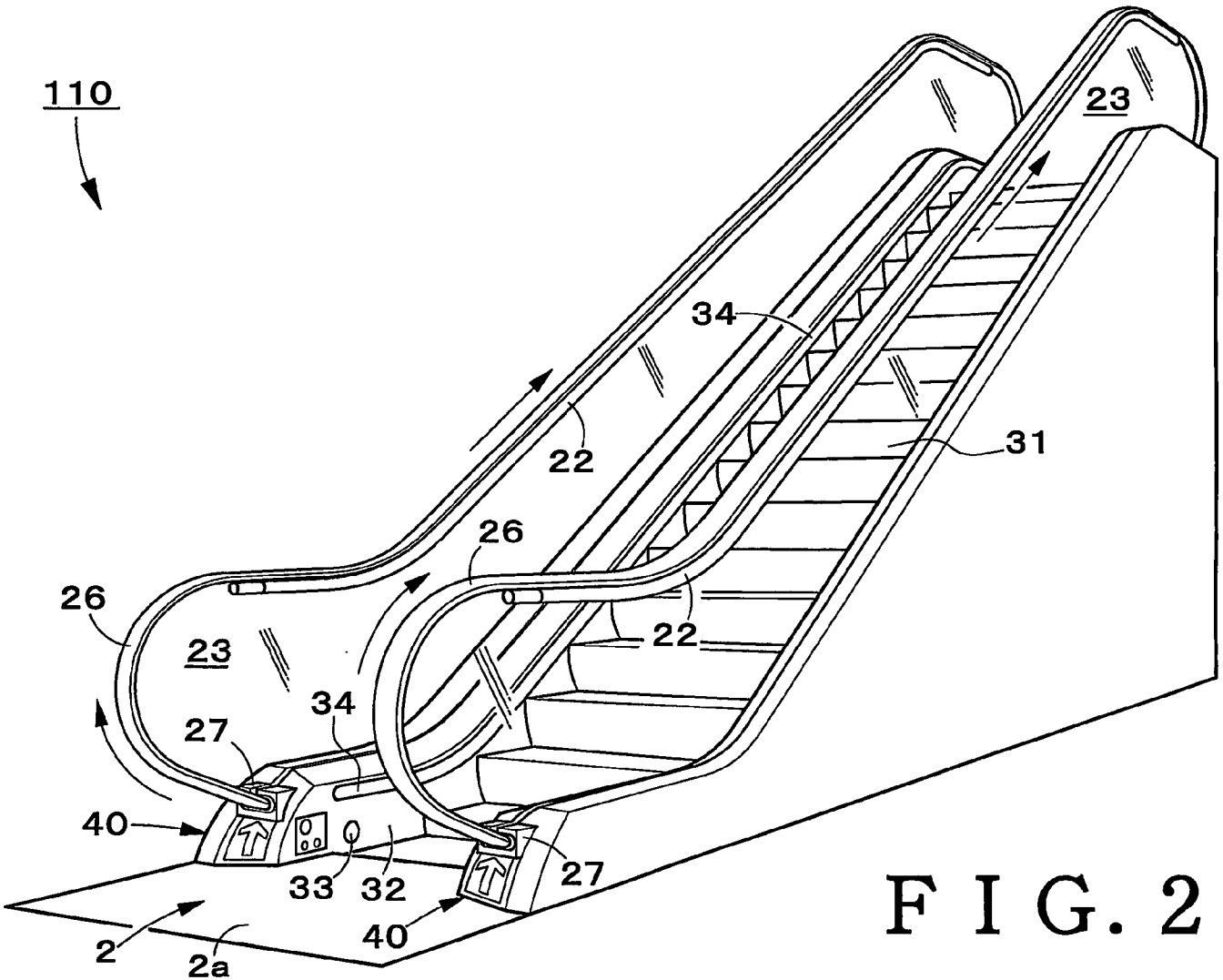
FIG. 2 is a general perspective view showing a passenger conveyor of a second embodiment of the present invention.
Figure 3:
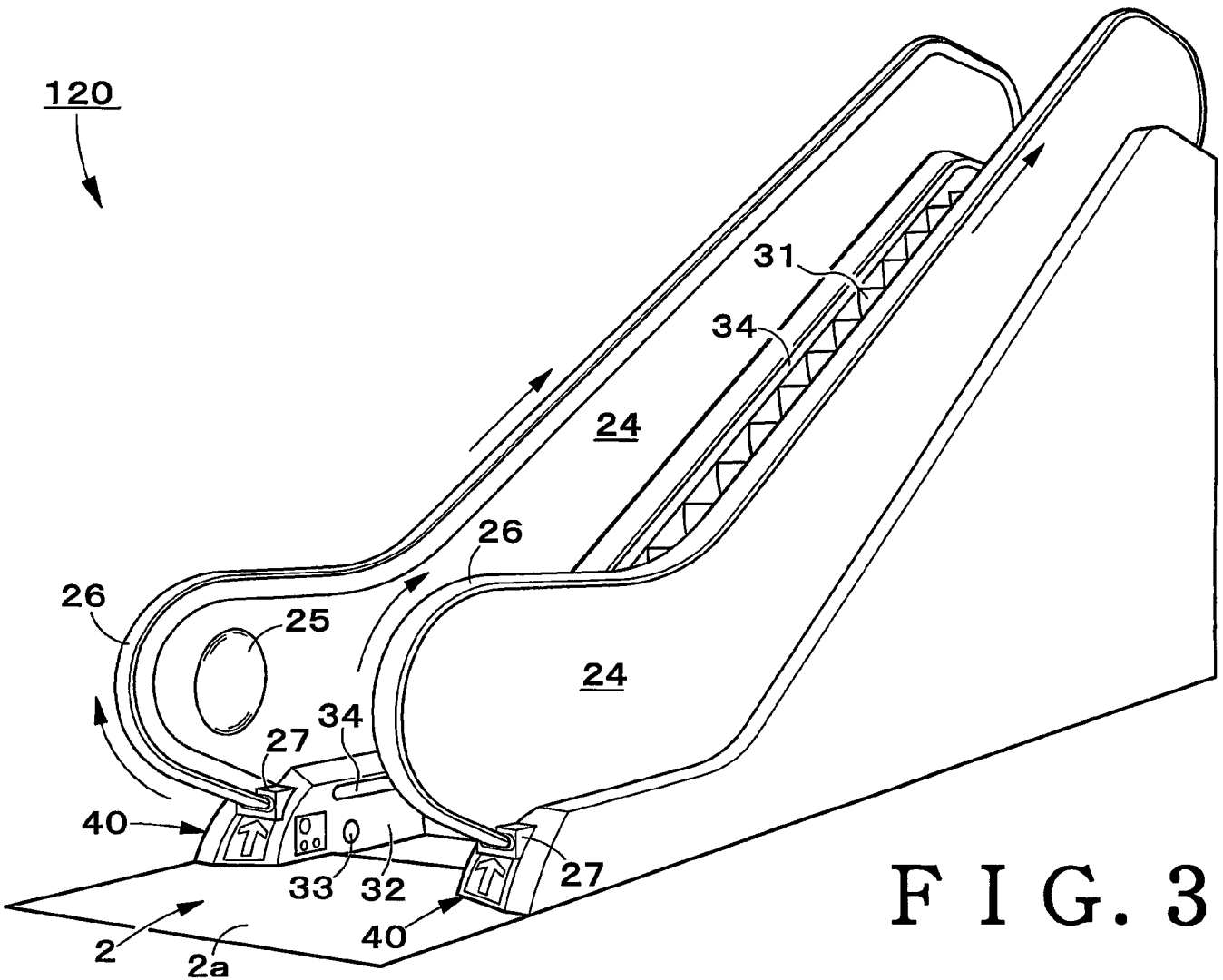
FIG. 3 is a general perspective view showing a passenger conveyor of a third embodiment of the present invention.

Escalators (passenger conveyors) 100, 110, 120 respectively shown in FIGS. 1 to 3 serve to transfer passengers from a ground floor to a second floor in a building. The escalator 100 shown in FIG. 1 has a balustrade panel 21 formed by a single transparent reinforced glass.

The escalator 110 shown in FIG. 2 has a balustrade panel 23 formed by two transparent reinforced glasses parallel to each other, and a handrail light 22 is received in a space between the two glasses of the balustrade panel 23.

The escalator 120 shown in FIG. 3 has a handrail 24 formed by a stainless plate, and a platform light 25 disposed thereon to face a platform.

Each of the escalators 100, 110, 120 has a step light 34 which is described hereinbelow.

As shown in FIGS. 1 to 3, the balustrade panels 21, 23, 24 of the respective escalators 100, 110, 120 support an endlessly extending handrail 26 and guide a movement thereof. The handrail 26 extends from (enters and exits) an inlet part 27 disposed near a floor 2*a* of a platform 2 at an end of each of the balustrade panels 21, 23, 24.

Figure 4:
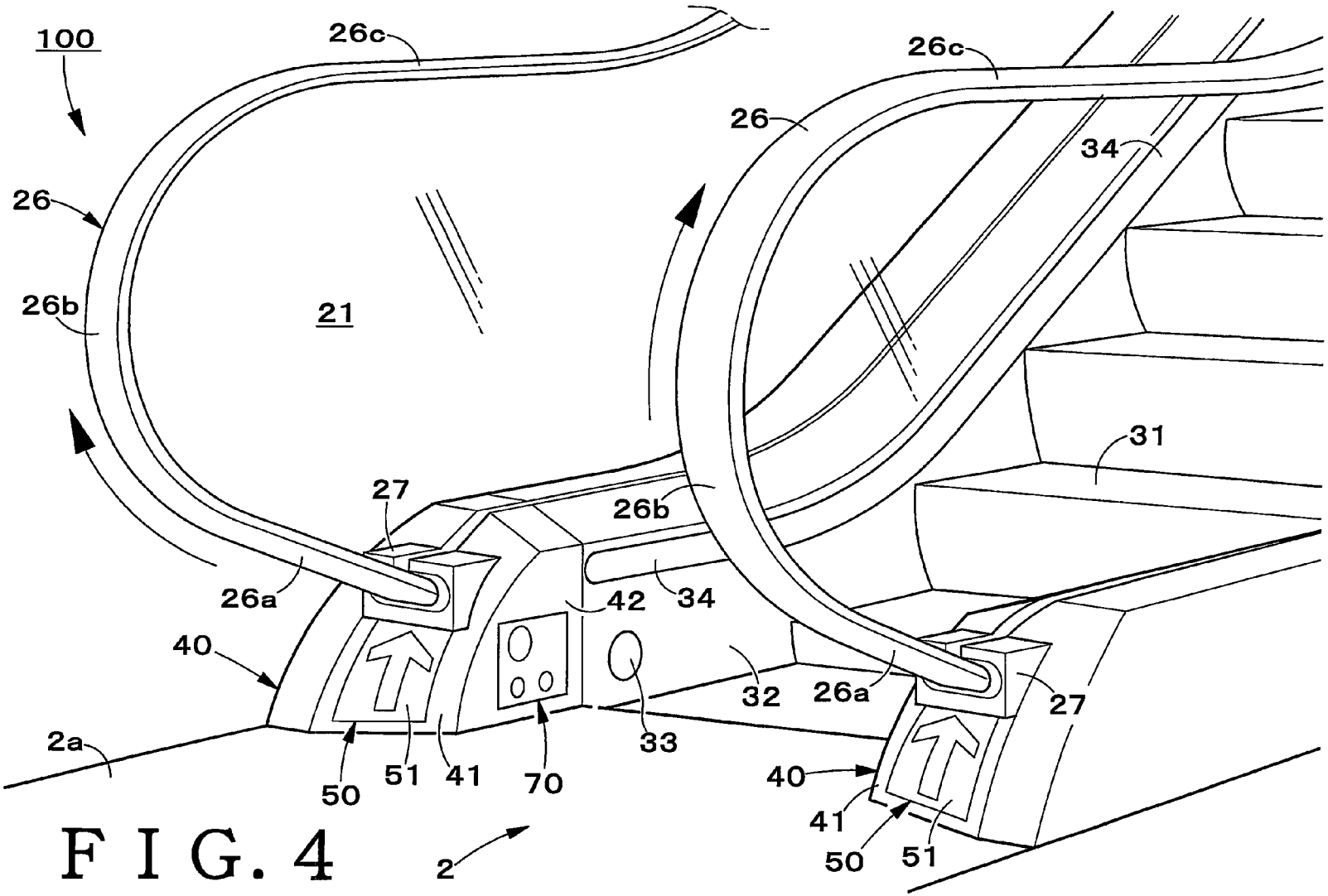
FIG. 4 is an enlarged perspective view showing an essential part of FIG. 1.

As shown in FIG. 4 in enlargement, the handrail 26 has a part 26*a*, a part 26*b*, and a part 26*c*. The part 26*a* moves out of the inlet part 27 to linearly extend at a predetermined angle relative to the floor 2*a* of the platform 2 when viewed horizontally from the lateral side. The part 26*b* moves upward along an arcuate curve. The part 26*c* extends parallel to the floor 2*a* of the platform 2.

Figure 5:
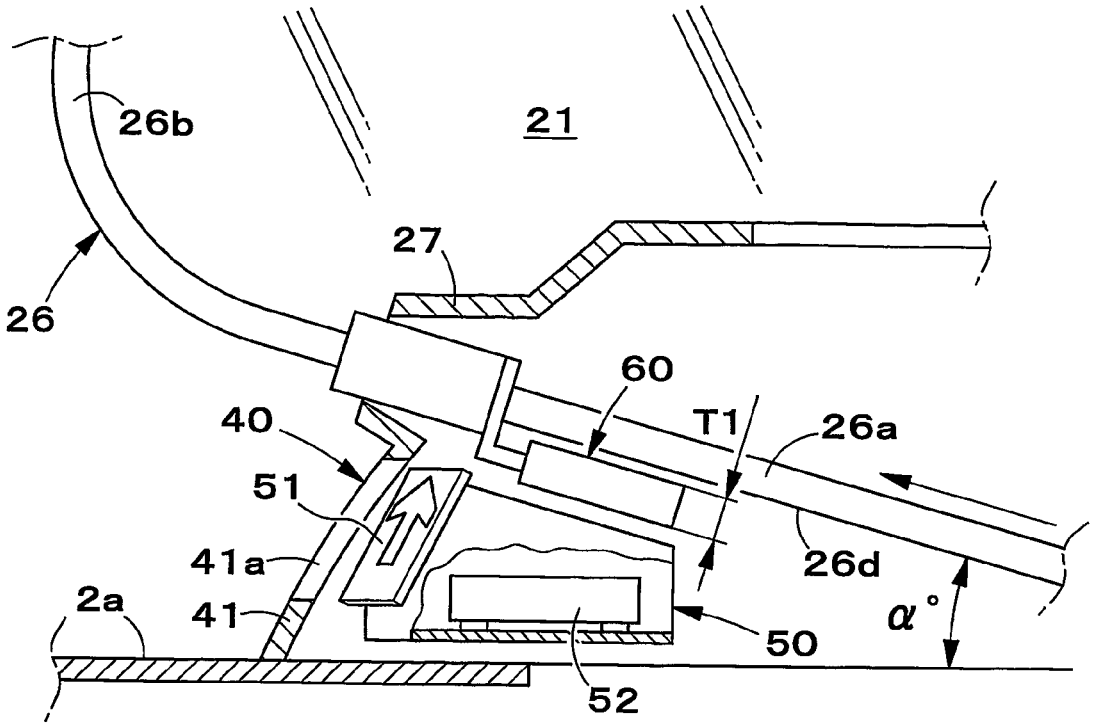
FIG. 5 is a longitudinally sectional view schematically showing an interior of an end-deck cover.

As clearly shown in FIG. 5, since the linear part 26*a* of the handrail 26 is inclined at an angle a relative to the floor 2*a* of the platform 2, a larger space can be secured between a lower surface 26*d* of the handrail 26 and the floor 2*a*. Thus, there is less risk for a passenger to be caught therein.

Further, the larger space between the lower surface 26*d* of the handrail 26 and the floor 2*a* can provide a space necessary to receive therein an operation condition display device 50, an inlet safety device 60, an operation device 70, and a passenger detecting device 80, which are described hereinbelow.

As shown in FIG. 4 in enlargement, an end-deck cover 40 covering a surrounding area of the inlet part 27 out of which the handrail 26 moves is disposed near the floor 2*a* of the platform 2 at an end of the balustrade panel 21.

Figure 8:
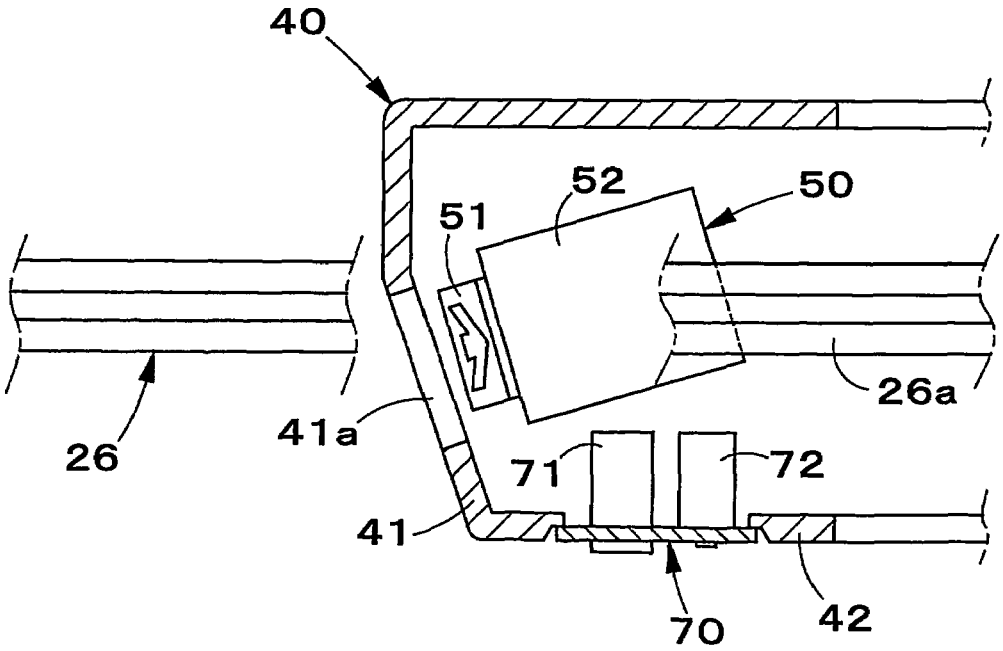
FIG. 8 is a horizontal view schematically showing the interior of the end-deck cover.

As best shown in FIG. 5, the end-deck cover 40 has an inclined surface 41 which is inclined to face an upper side of a center part of the platform 2 when viewed horizontally from the lateral side. As best shown in FIG. 8, the inclined surface 41 is inclined to face the center part of the platform 2 when viewed vertically from above.

A display part 51 of the operation condition display device 50 is disposed along a rear surface of the inclined surface 41.

A passenger approaching the platform 2 can easily observe various indications displayed by a number of light emitters disposed on the display part 51, through a transparent window 41*a* formed on the inclined surface 41.

The display part 51 can display an "arrow mark" indicating that the escalator 100 is available, a "DO NOT ENTER mark" indicating that the escalator 100 is reversely moved so that the escalator 100 is unavailable from the side in question, and a "character mark" such as "AUTOMATIC" indicating that the escalator 100 is automatically operated.

As shown in FIG. 5, the operation condition display device 50 has the display part 51 and a display control part 52 horizontally arranged rearward the display part 51. The display part 51 has light emitters for displaying information which are disposed along the inclined surface 41 of the end-deck cover 40.

Figure 6:
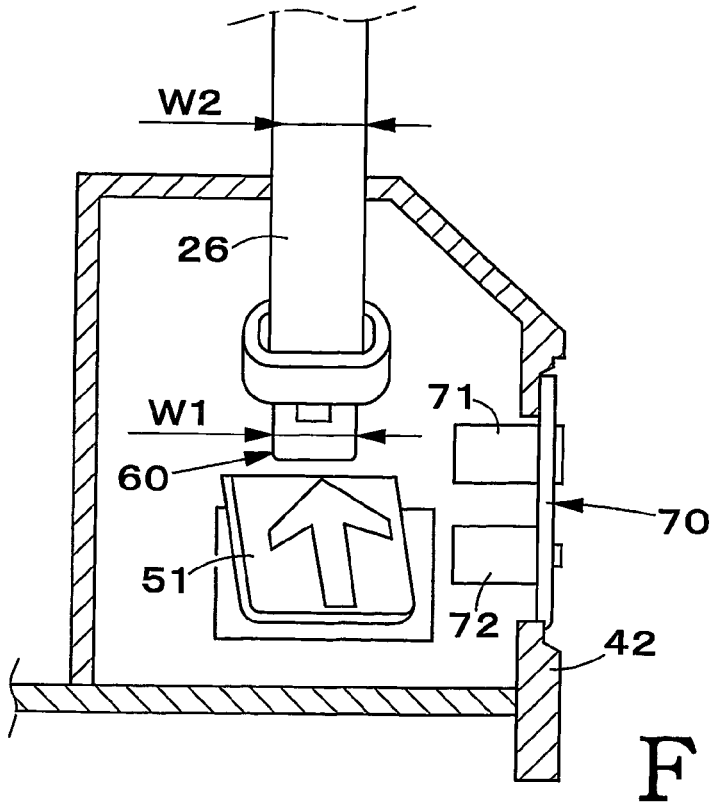
FIG. 6 is a cross-sectional view schematically showing the interior of the end-deck cover.

As shown in FIG. 5, the handrail inlet safety device 60 is formed such that a body thereof has a smaller thickness dimension T1 when viewed from the lateral side. As shown in FIG. 6, a width dimension W1 of the handrail inlet safety device 60 Is formed equal to or smaller than a width dimension W2 of the handrail 26 when viewed from the front. Thus, the handrail inlet safety device 60 can be arranged in the end-deck cover 40 along the lower surface 26*d* of the handrail 26.

Therefore, the operation condition display device 50 and the handrail inlet safety device 60 can vertically be laid out, and thus compactly received inside the end-deck cover 40, which is a triangular space formed between the lower surface 26*a* of the handrail 26 and the floor 2*a* of the platform 2 when viewed horizontally from the lateral side.

Figure 7:
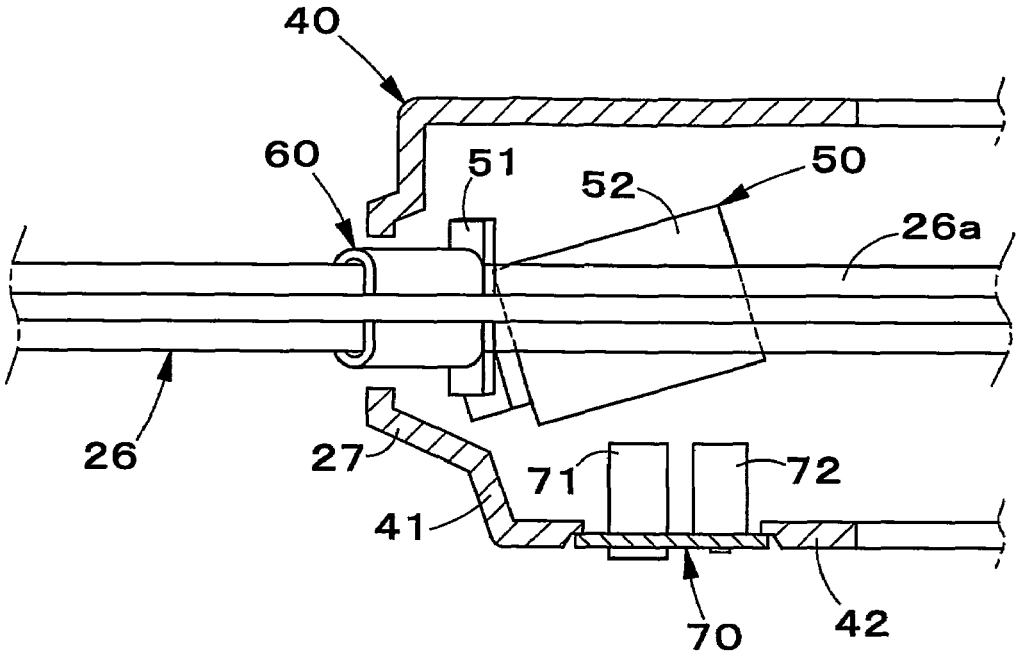
FIG. 7 is a horizontal view schematically showing the interior of the end-deck cover.

As shown in FIGS. 6 to 8, the operation device 70 operating the escalator 100 can be positioned in the end-deck cover 40 on a side of the operation condition display device 50 and the handrail inlet safety device 60 which are vertically laid out in the end-deck cover 40.

Such a constitution allows switches 71 and 72 of the operation device 70 to be disposed in the end-deck cover 40 away from a step 31. Accordingly, a safety of the escalator 100 operated by the operation device 70 can be improved.

Figure 9:
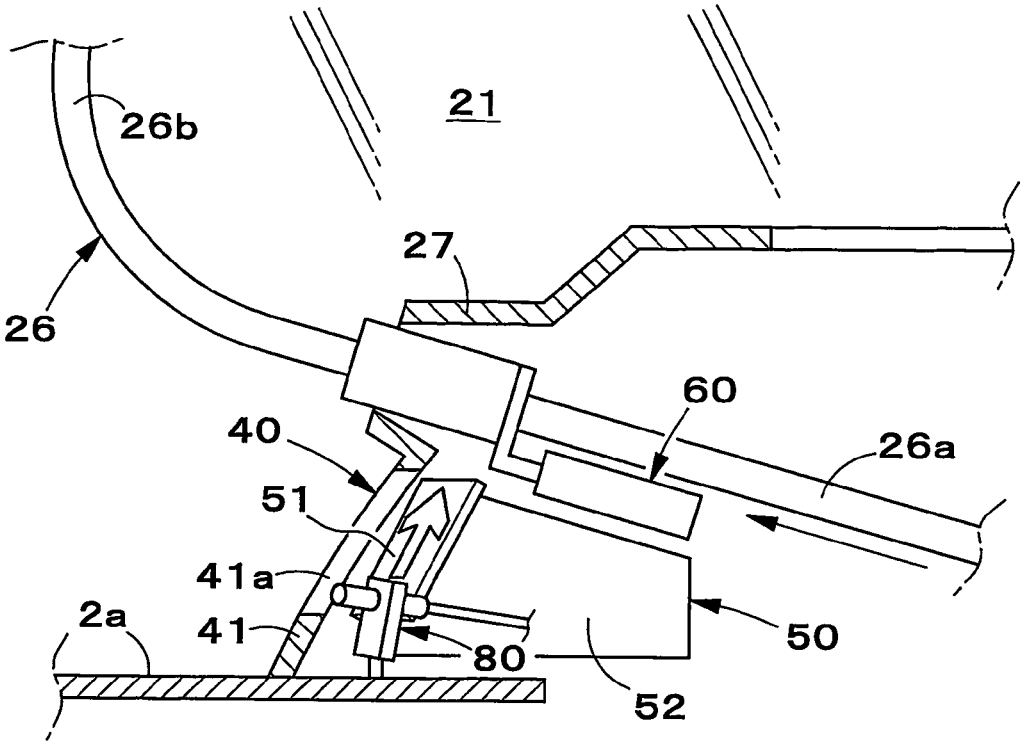
FIG. 9 is a longitudinally sectional view schematically showing a passenger detecting device disposed in the end-deck cover.
Figure 10:
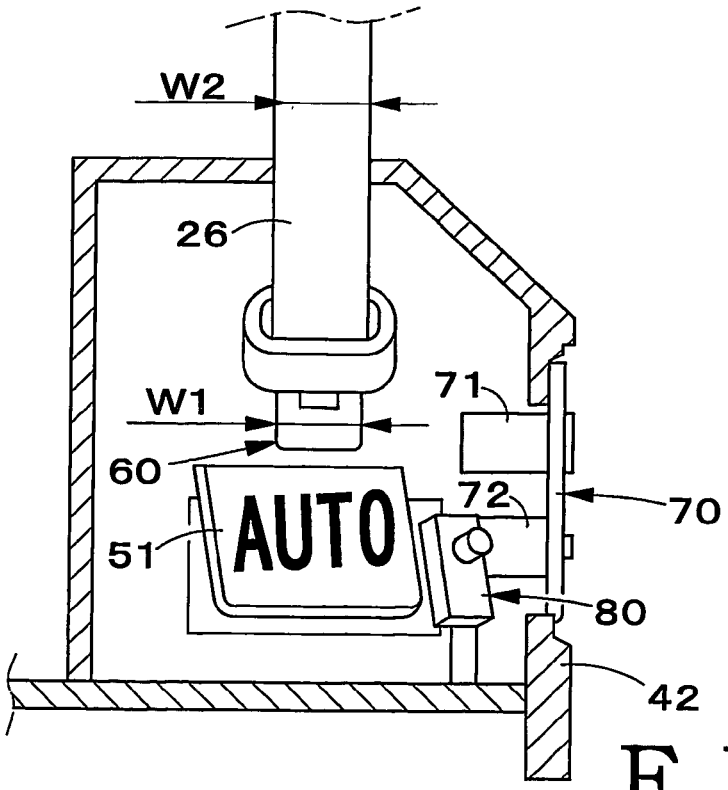
FIG. 10 is a cross-sectional view schematically showing the passenger detecting device disposed in the end-deck cover.
Figure 11:
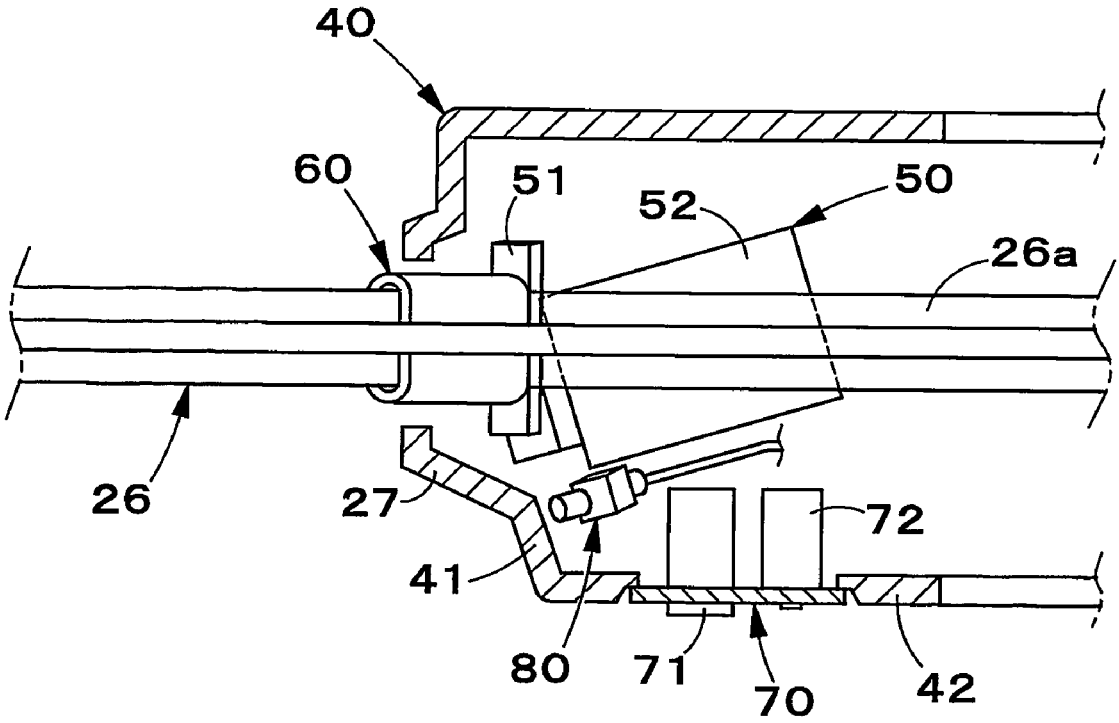
FIG. 11 is a horizontal view showing the passenger detecting device disposed in the end-deck cover.

As shown in FIGS. 9 to 11, the passenger detecting device 80 can be disposed in the end-deck cover 40 on a side of the display part 51 of the operation condition display device 50.

Such a constitution allows an infrared sensor of the passenger detecting device 80 to face the center part of the platform 2 through the window 41*a* formed on the inclined surface 41 of the end-deck cover 40. Accordingly, a passenger approaching the platform 2 can be surely detected.

As shown in FIGS. 1 to 3, a pair of right and left skirt guards 32 are disposed to laterally sandwich therebetween the step 31 where a passenger gets on. Each of the skirt guards 32 has a warning light 33 warning of a boundary between the platform 2 and the step 31, and the strip-like step light 34 continuously extended along a length of the skirt guard 32.

Figure 12:
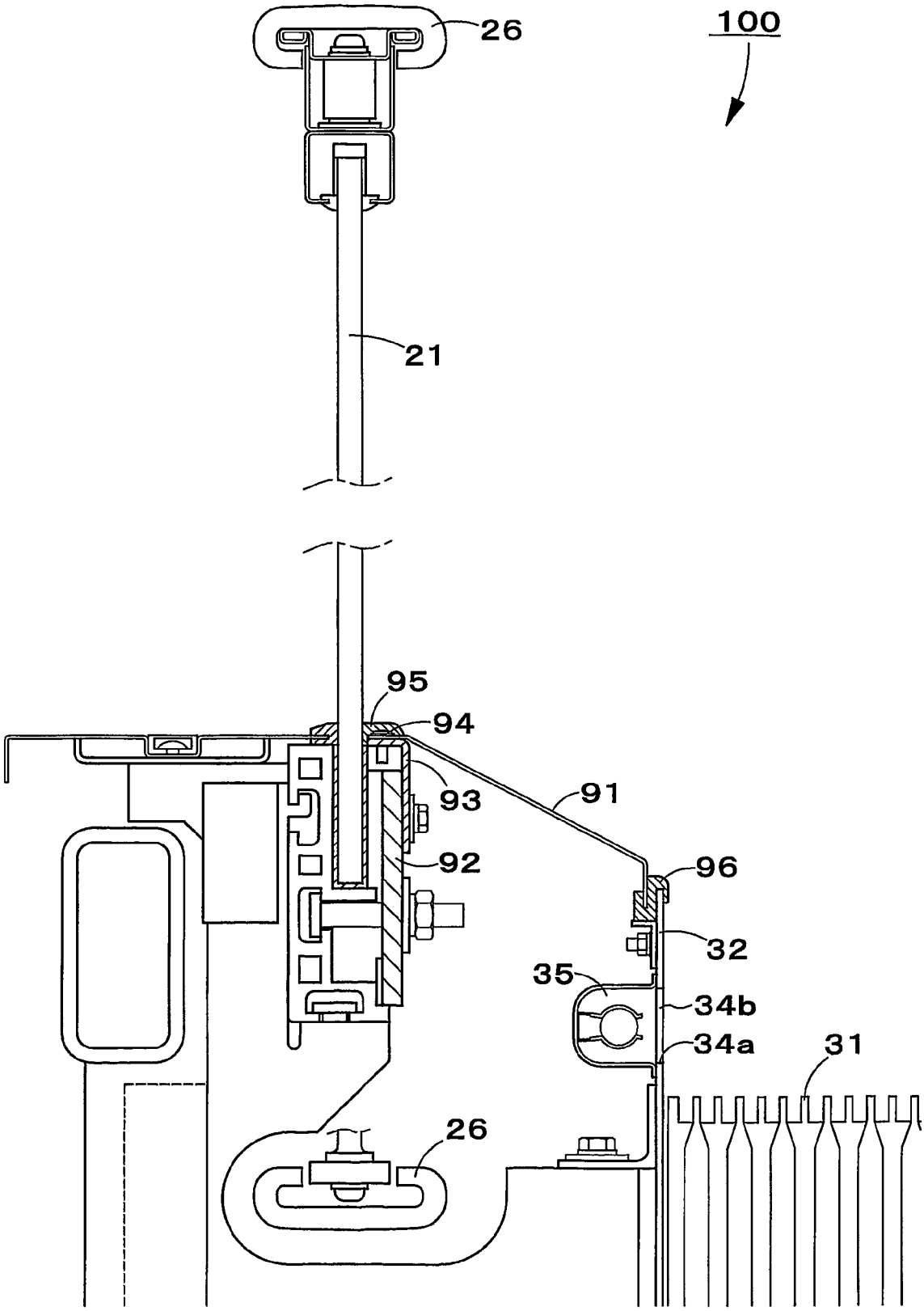
FIG. 12 is a cross-sectional view showing a structure of a balustrade panel.
Figure 13:
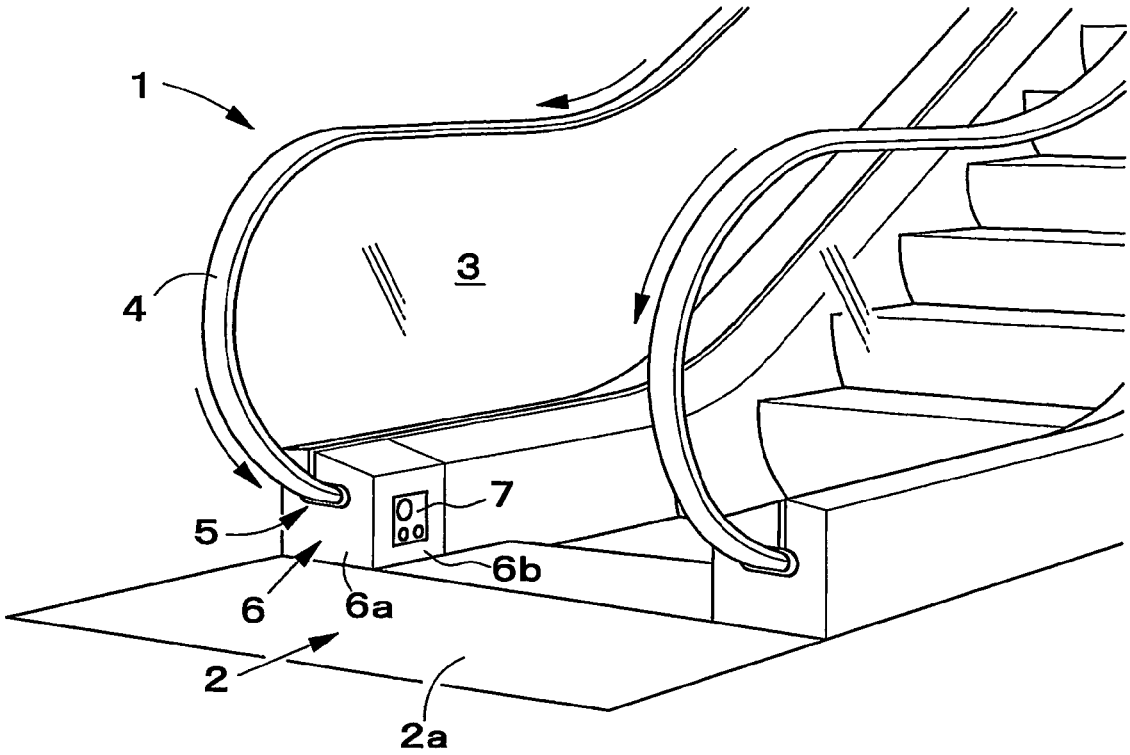
FIG. 13 is a perspective view showing a platform of a conventional escalator.
Figure 14:
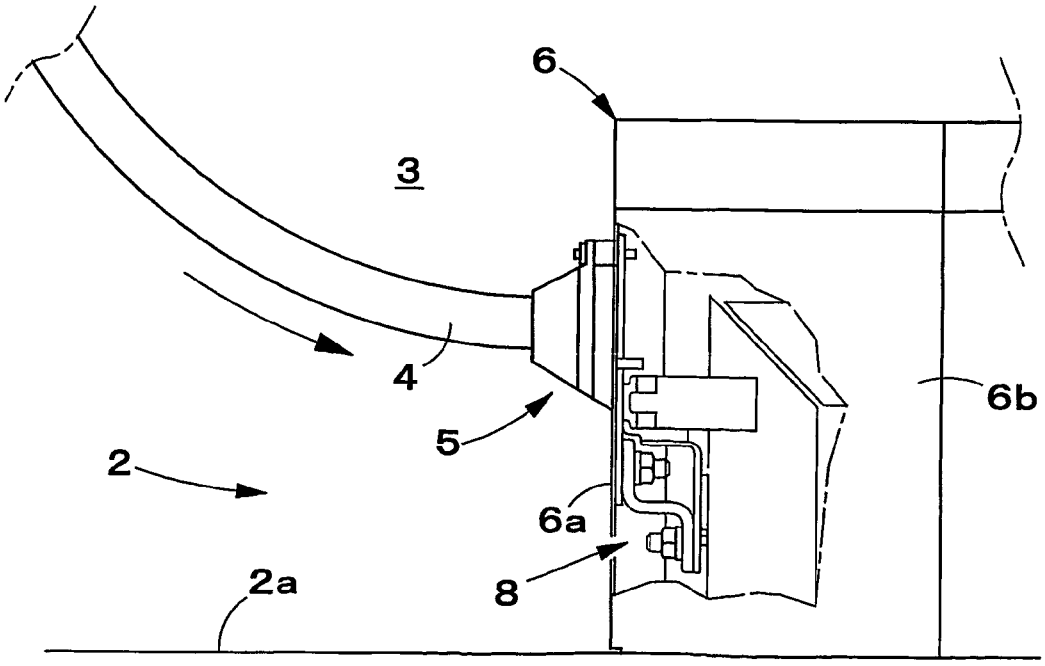
FIG. 14 is a longitudinally sectional view showing a handrail inlet portion of the conventional escalator.
Figure 15:
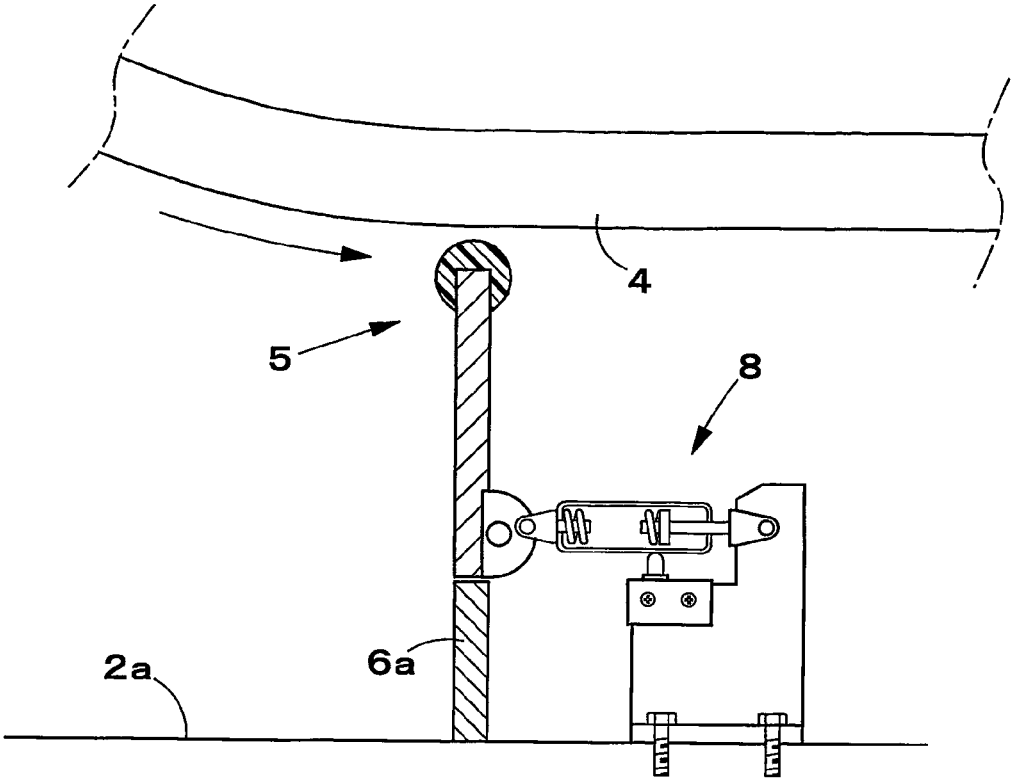
FIG. 15 is a longitudinally sectional view showing a handrail inlet portion of another conventional escalator.
Figure 16:
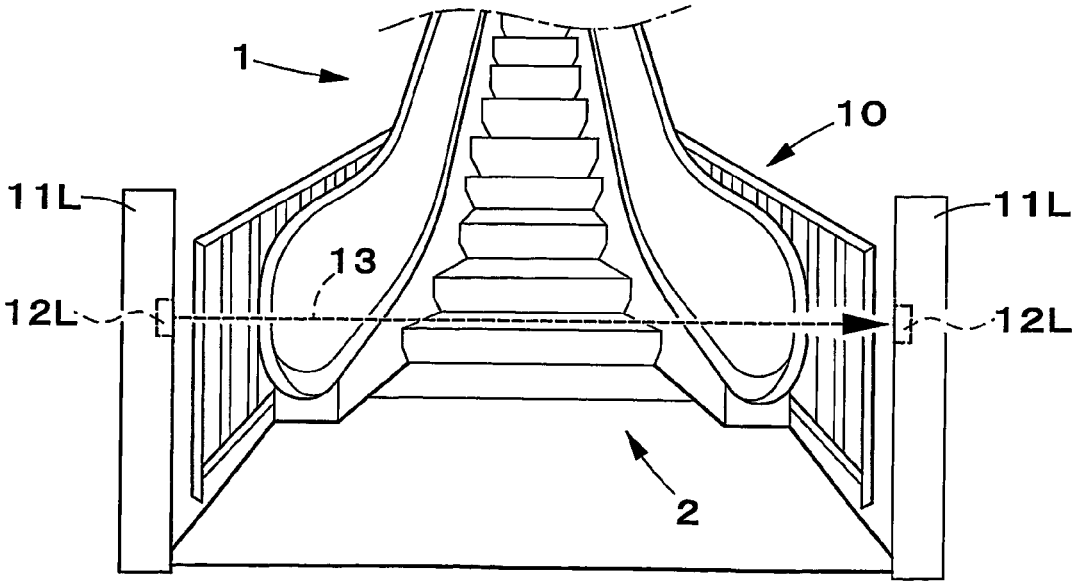
FIG. 16 is a front view showing the platform of the conventional escalator.
Figure 17:
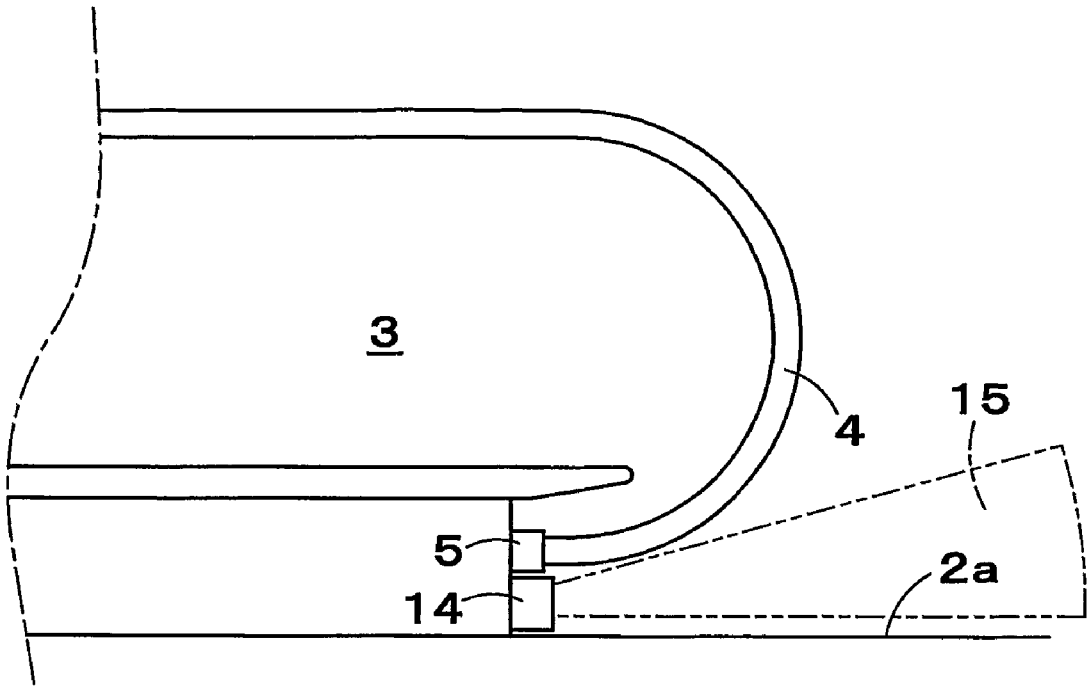
FIG. 17 is a side view showing the handrail inlet portion of the conventional escalator.

As shown in FIG. 12, the step light 34 has a light window 34*a* formed on the skirt guard 32, a white resin plate 34*b* fitted in the light window 34*a*, and a fluorescent light 35 disposed inside the skirt guard 32.

Thus, not only can the step 31 be brightly lighted, but also the boundary between the step 31 and the skirt guard 32 can be readily identified. Therefore, troubles such as a passenger's shoe being caught in a gap therebetween can be prevented from occurring.

As shown in FIG. 12, a surface plate 91 of an outside wall surface forming the balustrade panel 21 provides an outside wall surface facing the step 31 where a passenger gets on. The surface plate 91 is thread-mounted and secured on a bracket 93 fixed on a frame 92 by a screw 94.

A head of the screw 94 is covered with an ornamental member 95 attached on an outer surface of the surface plate 91.

Since the head of the screw 94 securing the surface plate 91 is invisible to a passenger on the step 31, an appearance of the balustrade panel 21 becomes more attractive and a design thereof is enhanced.

A connection member 96 made of resin or metal has substantially an S-shaped longitudinal section. An end of the surface plate 91 is inserted in one U-shaped groove of the connection member 96, while an end of the skirt guard 32 is inserted in the other U-shaped groove, whereby the surface plate 91 and the skirt guard 32 are supported. The surface plate 91 and the skirt guard 32 do not directly contact each other because of the connection member 96. Thus, a design of the balustrade panel 21 can be improved as well as an occurrence of disadvantages to a passenger can be prevented.

The embodiments of the passenger conveyor according to the present invention have been described in detail above. However, the present invention is not limited thereto, and various changes and modifications are naturally possible.

For example, although all the embodiments are related to an escalator, the present invention can of course be applied to a moving walkway.

Various information such as pictorial symbols displayed in a display part may be indicated by any means such as lighting, flickering, flowing the symbols in a vertical or lateral direction, provided that a passenger can acknowledge the indication.

In addition, apart from the above description, various information displayed in a display part can include information about shops in a building and events held therein where an escalator is installed. Not limited to a single pictorial symbol, two or more pictorial symbols can be displayed in the display part.

A passenger detecting device may be of any type, provided that a sensor thereof can detect a passenger. For example, the passenger detecting device may be a non-contact type sensor such as a light sensor, a heat-sensitive sensor, an ultrasonic sensor, and a human sensor. Alternatively, the passenger detecting device may be a contact type sensor such as a load sensor.

The invention claimed is:

1. A passenger conveyor including an escalator and a moving walkway, comprising:

a handrail endlessly moving along an outer periphery of a balustrade panel;

an end-deck cover disposed at an end of the balustrade panel near a floor of a platform, for covering a part where the handrail enters and exits;

a handrail inlet safety device configured to stop an operation of the passenger conveyor when a foreign matter is drawn into the part where the handrail enters and exits;

an operation device configured to operate the passenger conveyor; and an operation condition display device including a display part configured to display an operation condition of the passenger conveyor to a passenger; wherein the handrail inlet safety device, the operation device, and the operation condition display device are disposed in the end-deck cover.

2. The passenger conveyor according to claim 1, wherein a passenger detecting device for detecting an approach of a passenger is disposed in the end-deck cover.

3. The passenger conveyor according to claim 2, wherein the passenger detecting device is arranged in the end-deck cover on a side of the display part of the operation condition display device.

4. The passenger conveyor according to claim 1, wherein the part where the handrail enters and exits is formed on the end-deck cover such that the handrail is linearly extended at a predetermined angle relative to the floor of the platform when viewed horizontally from the lateral side.

5. The passenger conveyor according to claim 1, wherein the handrail inlet safety device is formed to have a width dimension equal to or smaller than a width dimension of the handrail when viewed from the front, and a smaller thickness when viewed from the lateral side, and the handrail inlet safety device is arranged in the end-deck cover along a lower surface of the handrail.

6. The passenger conveyor according to claim 5, wherein the operation condition display device is arranged in the end-deck cover below the handrail inlet safety device.

7. The passenger conveyor according to claim 6, wherein the operation device is arranged in the end-deck cover on a side of the handrail inlet safety device and the operation condition display device.

8. The passenger conveyor according to claim 1, wherein the end-deck cover has an inclined surface along which a display surface of the operation condition display device is disposed, and the inclined surface is inclined to face a center part of the floor of the platform when viewed vertically from above, and is inclined to face an upper side of the center part when viewed horizontally from the lateral side.

9. The passenger conveyor according to claim 8, wherein the display part of the operation condition display device is disposed along the inclined surface of the end-deck cover, and a display control part of the operation condition display device is horizontally arranged rearward the display part.

10. The passenger conveyor according to claim 1, wherein the operation condition display device is disposed in an inner space of the end-deck cover, which is a triangular space formed between a lower surface of the handrail extending in the end-deck cover and the floor of the platform when viewed horizontally from the lateral side.

11. The passenger conveyor according to claim 1, further comprising:

a surface plate of an outside wall surface forming the balustrade panel, which provides an outside wall surface facing a step where a passenger gets on;

a screw for thread-mounting the surface plate on a frame; and an ornamental member attached on an outer surface of the surface plate, for covering a head of the screw.

12. The passenger conveyor according to claim 1, further comprising:

a surface plate of an outside wall surface forming the balustrade panel, which provides an outside wall surface facing the step where a passenger gets on and off;

a skirt guard extended in a predetermined direction near the step where a passenger gets on and off; and a connection member having substantially an S-shaped section, for connecting the surface plate and the skirt guard.

13. The passenger conveyor according to claim 12, wherein the connection member has one U-shaped groove to which an end of the surface plate is inserted and the other U-shaped groove to which an end of the skirt guard is inserted, to thereby support the surface plate and the skirt guard.

14. The passenger conveyer according to claim 1, further comprising:

a skirt guard extending adjacent to a step where a passenger gets on and off; and a strip-like light means for lighting the step, which is disposed on the skirt guard and is extended along a length thereof.

* * * * *